US006564169B1

(12) United States Patent
Kotlow

(10) Patent No.: US 6,564,169 B1
(45) Date of Patent: May 13, 2003

(54) METHOD FOR WIRE GUIDANCE TONE CERTIFICATION

(75) Inventor: Dominik A. Kotlow, Wakefield, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 188 days.

(21) Appl. No.: 09/606,116

(22) Filed: Jun. 12, 2000

(51) Int. Cl.[7] ..... G04F 1/00
(52) U.S. Cl. ..... 702/176; 345/340
(58) Field of Search ..... 702/176; 345/340

(56) References Cited

U.S. PATENT DOCUMENTS 5,542,390 A * 8/1996 Hartman et al. ..... 364/487
5,579,462 A * 11/1996 Barber et al. ..... 395/140
6,229,536 B1 * 5/2001 Alexander et al. ..... 345/340
6,320,577 B1 * 11/2001 Alexander ..... 345/339

* cited by examiner

*Primary Examiner*—John S. Hilten
*Assistant Examiner*—Stephen J. Cherry
(74) *Attorney, Agent, or Firm*—James M. Kasischke; Michael F. Olgo; Jean-Paul Nasser

(57) ABSTRACT

A method is provided to capture and process wire guidance fire control command tones. The method is implemented on a computer, which monitors and displays the wire guidance command tones in real time, showing the tone or signal over time. A user controls the beginning and ending of the capture period. The captured data is stored within the computer. Once data capturing has ended, the full record of the captured data is displayed. The display includes active cursors denoting the start and stop of the recorded event. The cursors may be positioned independently along the data display so as to bracket a tone event of interest. Once the cursors are positioned, the method updates the display to show only the bracketed event. The time duration of the event is also shown as well as a computed frequency for the event. The user may then continue refining the positions of the cursors to accurately identify the event of interest. Once the event has been satisfactorily identified, the duration and frequency may be compared to specified parameters to certify or reject the wire guided fire control command tone signaling system.

12 Claims, 1 Drawing Sheet

METHOD FOR WIRE GUIDANCE TONE CERTIFICATION

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to wire guided weapons testing, and more particularly to a method for recording, displaying and certifying fire control tones being sent to a weapon over a guide wire.

(2) Description of the Prior Art

In order to certify that proper fire control tones are being sent to a wire guided weapon during an actual launch, test launches are conducted in which the weapon is launched and fire control command tones are sent to the launched weapon. The wire guidance command tones are recorded on a strip chart, which must be manually analyzed using a calibrated time-scale to establish tone duration. The tone frequency can be obtained by physically counting the peaks over a time frame. In order for the peaks to be distinguished, the strip chart recorder must be run at maximum speed, creating extremely long recordings for each test firing. The manual interpretation of the strip chart is time consuming and prone to error and is very dependent on the experience level of the personnel performing the measurements.

SUMMARY OF THE INVENTION

Accordingly, it is an object of the present invention to provide a method to obtain command tone signals for a wire guided weapon during a test launch.

Another object of the present invention is to provide a method to analyze the command tone signals, which does not rely on manual interpretation of the collected data.

A further object of the present invention is to provide a method to certify that the frequency and duration of the command tone signals are within proper operating parameters.

Other objects and advantages of the present invention will become more obvious hereinafter in the specification and drawings.

In accordance with the present invention, a method is provided to obtain and process wire guidance fire control command tones. The method is implemented on a computer, which is used in lieu of the strip chart recorder to capture the command tones. When initiated, the method begins data monitoring and displays the data in real time, showing the tone, or signal over time. The real time display is typically updated once per second, or at some other predetermined time period. A user controls the beginning and ending of the capture period by pressing a RECORD/STOP RECORD button. The button may be either a visual display that activates data recording when "pressed" by a user mouse click on the display, or may be an electromechanical switch connected with the computer. The captured data is stored within the computer. The file structure of the stored data may include the hull number of the vessel conducting the test, the tube number from which the weapon is fired, the test event, the run number within the event and an identification of the weapon being fired. When the user presses the RECORD/STOP RECORD button once again, no further data is captured and the full record of the captured data is displayed. The display includes active cursors denoting the start and stop of the event. The user may position the cursors independently along the data display so as to bracket a tone event of interest. Once the cursors are positioned, the display is updated to show only the bracketed event along with an indication of the time duration of the event. In addition, the display also shows the signal frequency within the bracketed event. The method may use any one of several well known fast Fourier transform algorithms operating on the data between the cursor locations to calculate the frequency. The user may then continue refining the positions of the cursors to accurately identify the event of interest. Once the event has been satisfactorily identified, the duration and frequency may be compared to specified parameters to certify or reject the wire guided fire control command tone signaling system.

Thus, the method of the present invention provides a computerized method of obtaining and analyzing command tone signals for a wire guided weapon during a test launch. Manual interpretation of the data includes only locating a tone event of interest and positioning a set of cursors about the event. The method automatically calculates the tone duration and frequency based on the cursor positions. The cursor positioning may be further refined to more accurately analyze the event and to certify or reject the system based on the analysis.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing, labeled as FIG. 1 and showing a flow chart representation of the method of the present invention.

DESCRIPTION OF THE PREFERRED EMBODIMENT

Figure 1:
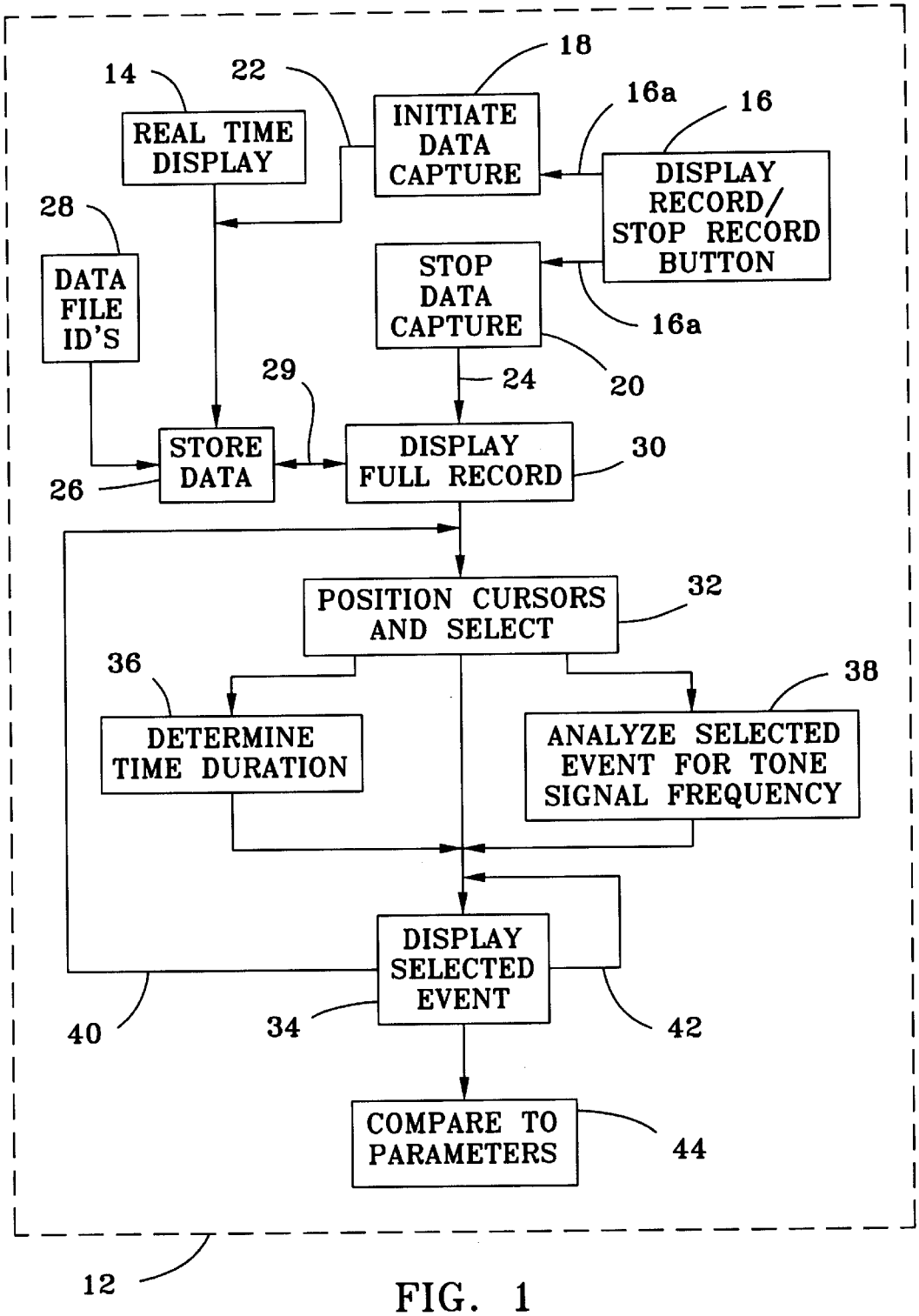

Referring now to FIG. 1, there is shown a flow chart representation of a method used to obtain and analyze command tone signals for a wire guided weapon during a test launch. The method is implemented on a computer 12, such as a computer used for controlling standard data acquisition systems. In the preferred embodiment, the data being acquired, or captured, consists of fire control command tones, or signals for a wire guided weapon being transmitted to the weapon over a period of time. In order to differentiate between commands, the duration and frequency of the tones are varied. When the method is initiated, computer 12 begins (at 14) monitoring and displaying in real time the signals being transmitted to and from the weapon. Preferably, the real time display is updated periodically over the course of the data capture. Such signal displays are common features of standard data acquisition systems. Computer 12 also preferably generates (at 16) a visual display of a mouse activated RECORD/STOP RECORD button. When activated by a user, indicated by activation lines 16*a*, the button initiates (at 18) or stops (at 20) data capture, as indicated by control lines 22 and 24, respectively. Once data capture is initiated, the captured data is stored in computer 12 at 26. The file structure for data storage may include such data identifiers as the hull number of the vessel conducting the test, the tube number from which the weapon is fired, the test event, the run number within the event and an identification of the weapon being fired. These identifiers are user inputs to the system as indicated at 28. Data capture and storage continues until the user activates the STOP RECORD button (16*a*, 20, 24). Once data capture is stopped, computer 12, using the stored data as indicated by link 29, generates and displays a full record of the captured data, showing the tone variation over time (30).

In addition to the data record, an active cursor is displayed at both the start and end of the record. The cursors are independently positionable by the user, so as to bracket and select a portion of the data record of interest (at 32). Once selected, the display is updated at 34 to show only the bracketed portion of the data record, with the active cursors shown at the start and end of the bracketed portion. Updating the display also involves computer 12 determining (at 36) and displaying the time duration of the selected record portion. In addition, computer 12 analyzes the selected record data to determine the tone signal frequency within the selected time frame (at 38) and displays the results of the analysis. In a preferred embodiment, the analysis is performed using any of several well known Fast Fourier Transform analyses on the selected record. The user can then reposition the active cursors to further refine the bracketed portion of the record as indicated by the return 40 to 32. The user may also return to the previously displayed portion of the record as indicated by the return 42 to 34. Once the bracketed portion, or event, has been satisfactorily refined, the duration and frequency may be compared to specified parameters to certify or reject the wire guided fire control command tone signaling system (44).

The invention thus described provides a method that eliminates manual interpretation of fire control command tones, while providing user control of the tone events to be analyzed. The tone duration and frequency are automatically determined to preclude human error. Further, a full record of the test results is available for further analysis, if necessary, without the need for storage of paper strip charts.

Although the present invention has been described relative to a specific embodiment thereof, it is not so limited. While the method has been described for the analysis of a fire control command tone for a wire guided weapon, the use of the active cursors to iteratively refine an event of interest can be applied to any data set where events of interest must be determined and analyzed. Also, the method can be used to monitor any signal for which frequency and/or time duration are required. Further, the RECORD/STOP RECORD button may be an electromechanical switch interfaced with the computer, rather than a visual display button.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method implemented in a computer for user analysis of a set of data having at least one event of interest, the method comprising:

storing the data set in the computer;

displaying the full data set;

displaying a pair of cursors, one cursor being at a start of the displayed set, the other cursor being at an end of the displayed set, each cursor independently positionable on the displayed set;

positioning the cursors by the user at a first point and a second point along the displayed set, respectively, to select the event of interest;

displaying only a portion of the set between the first and second points as the displayed set when selected;

displaying and positioning the cursors by the user to further refine the event of interest;

providing reference parameters of the event of interest; and comparing the displayed portion with reference parameters of the event of interest so as to select between certification and rejection of a system for which the data set was obtained.

2. The method of claim 1, further comprising entering a user choice to display a previously displayed set after displaying the portion of the displayed set.

3. The method of claim 1, wherein storing the data set further comprises capturing the data set from a real time test.

4. The method of claim 1, further comprising attaching data set identifiers to the stored data set.

5. The method of claim 1, wherein displaying the portion further comprises:

determining a time duration for the portion;

analyzing the portion to determine a signal frequency within the portion; and displaying the time duration and the frequency with the displayed portion.

6. The method of claim 1, further comprising:

user activation of a control function to initiate storing the data set; and user activation of the control function to stop storing the data set.

7. The method of claim 5, wherein comparing the displayed portion with reference parameters further comprises comparing the duration and frequency of the displayed parameters with reference parameters of the event of interest so as to select between certification and rejection of a system for which the data set was obtained.

8. The method of claim 3, further comprising:

user activation of a control function to initiate capturing the data set; and user activation of the control function to stop storing the data set.

9. The method of claim 8, wherein the activation is accomplished by the user selecting a graphical user interface button displayed by the computer.

10. A computer implemented method of certifying command signals transmitted to and from a launched weapon comprising:

displaying the transmitted command signals in real time;

initiating capture of the command signal transmissions;

storing the captured signals in the computer;

displaying a full record of the captured signals when a stop capture control is selected;

displaying a pair of cursors, one cursor being at a start of the displayed record, the other cursor being at an end of the displayed record, each cursor independently positionable on the displayed record;

positioning the cursors by a user at a first point and a second point along the displayed record, respectively, to identify transmission of the command signal;

displaying only a portion of the record between the first and second points as the displayed record when selected;

iteratively displaying and positioning the cursors by the user to further refine the identification of the transmission;

providing reference parameters of the command signal; and comparing the displayed record with reference parameters of the command signal so as to select between certification and rejection of the command signal.

11. The method of claim 10, wherein displaying the portion of the record further comprises:

determining a time duration for the displayed record;

analyzing the displayed record to determine a command signal frequency within the displayed record; and displaying the time duration and the frequency with the displayed record.

12. The method of claim 11, wherein the analyzing comprises a Fast Fourier Transform of the displayed record.

* * * * *